US006595139B1

(12) United States Patent
Haeselich

(10) Patent No.: US 6,595,139 B1
(45) Date of Patent: Jul. 22, 2003

(54) IRRITATING BODY

(75) Inventor: Detlef Haeselich, Muessen (DE)

(73) Assignee: Nico-Pyrotechnik Hanns-Juergen Diederichs GmbH & Co. KG, Trittau (DE)

( * ) Notice: Subject to any disclaimer, the term of this patent is extended or adjusted under 35 U.S.C. 154(b) by 0 days.

(21) Appl. No.: 10/088,377

(22) PCT Filed: Sep. 4, 2000

(86) PCT No.: PCT/DE00/03098

§ 371 (c)(1),
(2), (4) Date: May 28, 2002

(87) PCT Pub. No.: WO01/20243

PCT Pub. Date: Mar. 22, 2001

(30) Foreign Application Priority Data

Sep. 16, 1999 (DE) ..... 199 44 486

(51) Int. Cl.[7] ..... F42B 12/46; F42B 8/12
(52) U.S. Cl. ..... 102/498; 102/368; 102/482
(58) Field of Search ..... 102/334, 345, 102/352, 355, 360, 364, 367, 368, 395, 482, 498, 502, 513, 529

(56) References Cited

U.S. PATENT DOCUMENTS 4,444,111 A * 4/1984 Luebbers ..... 102/360
4,976,201 A * 12/1990 Hamilton ..... 102/323
5,654,523 A * 8/1997 Brunn ..... 102/498

FOREIGN PATENT DOCUMENTS

DE 9213375 * 12/1992
WO PCT/DE93/00633 7/1993
WO WO 98/21541 * 5/1998

* cited by examiner

*Primary Examiner*—Harold J. Tudor
(74) *Attorney, Agent, or Firm*—Milde & Hoffberg, LLP

(57) ABSTRACT

The invention relates to an irritating body consisting of several compartments (6) which are substantially parallel to the central axis of the container (4) and which receive effect charges (8). All the compartments (6) are closed on the upper part of the container (4) and lead to a common chamber (18) which is open at the bottom on the opposite lower side of the container. The chamber has several side openings (22) arranged in the direction of the periphery. This construction reduces the danger of the user being wounded due to inappropriate use.

7 Claims, 1 Drawing Sheet

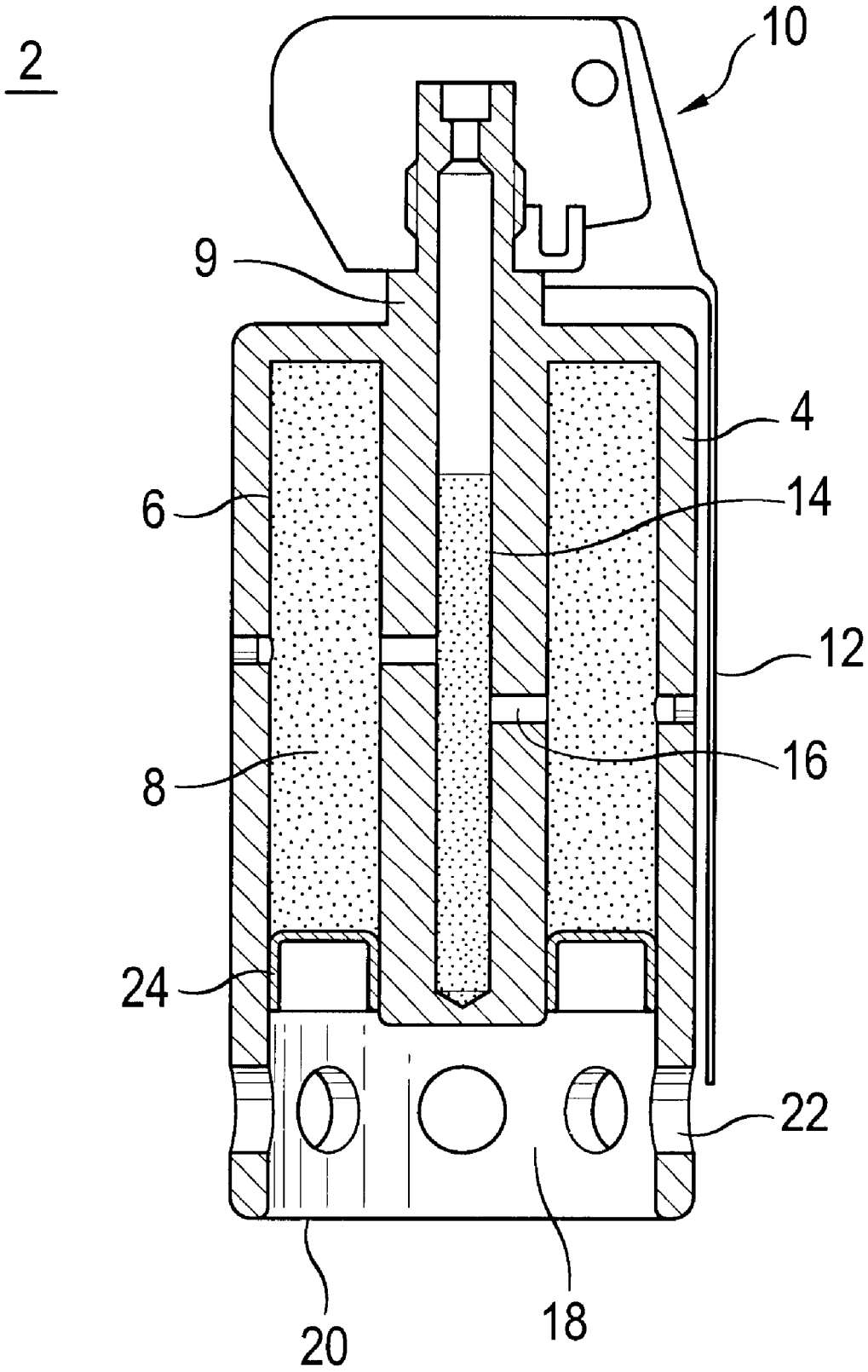
2
10
9
4
6
14
12
8
16
24
22
20
18

IRRITATING BODY

BACKGROUND OF THE INVENTION

The invention relates to an irritation body in the form of a hand grenade for producing irritations for offenders during police or military assignments, for example.

Irritation bodies are used, among other things, during hostage-takings or aircraft hijackings in order to overpower offenders. The irritation body is mostly similar to the shape of a hand grenade and is provided with a cylindrical receptacle with several compartments for active or effect changes, e.g. detonation or flash charges. The effect charges are ignited with the help of an ignition device, e.g. rocker igniting apparatus, which can be manually activated. The time-delay mechanism ensures that the individual effect charges are ignited within a sequence over several seconds. As a result of the bang produced during the ignition of the individual effect charges and the additionally occurring blinding effect, an irritation effect is to be produced on the respective person.

Such an irritation body is known from the printed publication WO 94/08200 of the applicant. In this irritation body, nine radially outwardly facing compartments with effect charges are housed in a cylindrical receptacle, which compartments are arranged in a manner so as to be offset about the central axis. The ignition device for the effect charges is provided with a common ignition duct with a time-delay charge which extends along the central axis of the receptacle. The individual compartments are connected at different heights with the ignition duct. A rocker igniting apparatus with a secured rocker lever is placed on the receptacle for the manual ignition.

For igniting the irritation body it is held in one hand, with the rocker lever being grasped simultaneously and being held in its secured position where it rests on the receptacle. With the other hand the safety device of the rocker is released by pulling the safety pin for example. When the irritation body is thrown, the lever flips upwardly by a spring and ignites the charge by way of a striking pin. After the ignition all effect charges in the receptacle are ignited in a time sequence. The recoil produced during the ignition of an effect charge displaces the irritation body. The irritation effect is increased particularly in the case of flash charges.

However, if during the release of the safety device the rocker lever igniting apparatus is not held by a hand, the lever will already flip up during the release of the safety device, as a result of which the effect charges may be ignited under certain circumstances although the irritation body is still held in the hand. The user may be injured or burnt on the hand by the radially outwardly directed explosion of the effect charges.

An irritation body is known from the same printed publication in which a total of six compartments are arranged in the longitudinal direction about the central axis of the irritation body and penetrate the irritation body in its entire length and are closed off at the upper and lower side by plugs. During the ignition of the effect charges the propellants exit from the receptacle upwardly and downwardly.

If the irritation body is improperly handled as described above and is still held during the ignition of the effect charges, the propellants will no longer exit directly in the direction towards the palms of the hand, as was the case in the previously described irritation body. However, the user will be injured in the face by the upwardly exiting propellants. The propellants exiting downwardly are generally not so hazardous, because they are usually directed against the floor.

One could avoid the danger of injuries during improper handling at least in part if one would seal off the compartments on the upper side of the receptacle, so that injuries in the face will practically no longer occur.

This design, however, has a serious disadvantage: If the properly thrown irritation body falls to the ground in such a way that during the ignition of the effect charges the propellants hit a close object such as the floor or a wall or if the irritation body comes to stand on the lower side of the receptacle, the irritation body will be ejected away in the manner of a projectile by the recoil of one or several ignited effect charges. This uncontrolled movement of the irritation body will lead to a high danger of injury for the persons located close by.

SUMMARY OF THE INVENTION

The invention is based on the object to modify an irritation body of the kind mentioned above in such a way that the danger of injuries is reduced even when improperly handled.

This object, as well as other objects which will become apparent from the discussion that follows, are achieved, according to the present invention, by means of an improvement wherein all compartments are sealed off on the upper side of the receptacle and open on the opposite lower side of the receptacle into a common chamber which is downwardly open and includes several outwardly facing lateral openings which are distributed around the chamber exterior.

By sealing off the compartments at the upper side of the receptacle, propellants can no longer exit in the direction of the user's face during improper handling. The propellants escape through the chamber and expand in the direction towards the floor, thus considerably reducing the danger of injuries.

If by chance the receptacle comes to stand on the downwardly open side of the chamber or comes to lie close to an object with this side, the propellants can escape through the lateral openings of the chamber, so that recoil occurring during the ignition is considerably diminished. As a result, the irritation body is no longer ejected in the manner of a projectile, but merely performs at most a minimal harmless movement.

In accordance with a preferred embodiment, the length of the chamber is one-fifth to one-third of the overall length of the receptacle.

Preferably, the receptacle with the compartments for the effect charges is of integral design.

For a full understanding of the present invention, reference should now be made to the following detailed description of the preferred embodiments of the invention as illustrated in the accompanying drawings.

BRIEF DESCRIPTION OF THE DRAWINGS

The single FIGURE shows a longitudinal sectional view through an irritation body in accordance with the invention;

DESCRIPTION OF THE PREFERRED EMBODIMENT

The preferred embodiment of the present invention will now be described with reference to single FIGURE of the drawings.

In the FIGURE, reference numeral 2 designates an irritation body which is provided with a receptacle 4 with six compartments 6 for an effect charge 8 each, which compartments are arranged in the longitudinal direction and are distributed around the circumference. Receptacle 4 further comprises on its upper side a centrally located extension 9 on which a manually actuatable rocker lever igniting apparatus 10 with a secured rocker 12 is placed, preferably screwed on. A bore used as an ignition duct 14 extends along the central axis of the receptacle, which bore also penetrates the extension 9. The individual compartments 6 are connected with the ignition duct 4 by punctured bores 16 which extend perpendicular to the ignition duct 14 and the compartments 6 and which are arranged successively in a mutually offset manner.

At the lower side of the receptacle which is opposite of the rocker lever igniting apparatus 10 a chamber 18 is provided in the receptacle into which all compartments 6 open. The floor 20 of the chamber is open and openings 22 are provided on the side of the wall of the receptacle at regular intervals in the circumference direction.

The compartments 6 are not guided completely through the receptacle 4 on the side of the rocker lever igniting apparatus 10, so that the compartments remain sealed off on said side. The openings of compartments 6 which open into the chamber 18 are closed off with a plug 24 once the compartments 6 are filled with effect charges. The ignition duct 14 ends within the receptacle shortly before the hollow space for the chamber.

The entire receptacle 4 is made integrally with the compartments 6, the ignition duct 14, the extension 9 and the chamber 18.

During the ignition of the effect charges by the rocker lever ignition apparatus 10, they are ignited in a time-sequenced manner, with the plugs 24 being ejected through the floor 20 of chamber 18 by the explosion of the effect charges and the effect such as a flash or a bang being initiated.

There has thus been shown and described a novel irritating body which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In an irritation body in the form of a hand grenade, comprising a receptacle having several compartments which extend substantially parallel to a central axis of the receptacle and house a plurality of effect charges, and comprising a manually actuatable igniting device on an upper side of the receptacle by which the effect charges are ignited in a time-sequenced manner, the improvement wherein all the compartments are sealed off on the upper side of the receptacle and open on an opposite lower side of the receptacle into a common chamber having an exterior which is downwardly open and includes several outwardly facing lateral openings which are distributed around the chamber exterior.

2. An irritation body as recited in claim 1, wherein the downwardly open chamber is arranged as an extension of the receptacle.

3. An irritation body as recited in claim 1, wherein the chamber has an axial length of one-fifth to one-third of the axial length of the receptacle.

4. An irritation body as recited in claim 1, wherein the receptacle with the compartments for the effect charges, a central ignition duct and the downwardly open chamber as well as an extension projecting from the upper side of the receptacle is of integral design, with the extension receiving an elongation of the ignition duct and a rocker lever igniting apparatus being placed on the extension.

5. An irritation body as recited in claim 1, wherein the compartments are sealed off with plugs on the side opening into the downwardly open chamber.

6. An irritation body as recited in claim 1, wherein the receptacle is substantially cylindrical.

7. An irritation body as recited in claim 4, wherein the rocker lever igniting apparatus is screwed onto the extension.

* * * * *